United States Patent [19]

Neely

[11] Patent Number: 4,471,894

[45] Date of Patent: Sep. 18, 1984

[54] AUTOMATICALLY RELEASABLE HANDGUN RETAINING STRAP ON HOLSTERS

[76] Inventor: Charles W. Neely, P.O. Box 27, Tijeras, N. Mex. 87059

[21] Appl. No.: 517,431

[22] Filed: Jul. 26, 1983

[51] Int. Cl.[3] ..... F41C 33/02

[52] U.S. Cl. ..... 224/243; 224/911

[58] Field of Search ..... 224/243, 192, 198, 206, 224/250, 255, 911, 912

[56] References Cited

U.S. PATENT DOCUMENTS

| | | | |
|---|---|---|---|
| 267,714 | 11/1882 | Petmecky | 224/912 X |
| 1,421,578 | 7/1922 | Schussler | 224/243 |
| 2,297,008 | 9/1942 | McMillan | 224/243 |
| 4,270,680 | 6/1981 | Bianchi | 224/198 X |
| 4,378,082 | 3/1983 | Chica | 224/243 |

*Primary Examiner*—Steven M. Pollard

*Attorney, Agent, or Firm*—Walter R. Keller

[57] ABSTRACT

On certain handguns, the firing pin protrudes through the rear of the weapon when the weapon is cocked, as an indication of the condition of the weapon. In the uncocked condition, the weapon is held in a holster by the retaining strap which has a conventional female snap which mates with a male snap mounted on the weapon around the firing pin extension orfice. Grasping the weapon, in the holster, and cocking the weapon by depressing the squeeze cocker, automatically cocks the weapon causing the firing pin to extend rearward, popping off the female snap and releasing the weapon to be withdrawn from the holster.

6 Claims, 4 Drawing Figures

AUTOMATICALLY RELEASABLE HANDGUN RETAINING STRAP ON HOLSTERS

BRIEF SUMMARY

The invention is a simple means for retaining a hand gun in a holster wherein the usual retaining strap attaches to the rear of the handgun instead of to the other side of the holster. The invention is specifically designed for weapons which are cocked by depressing a squeeze cocker on the handgrip, and wherein the cocking of the handgun causes the rear of the firing pin to protrude through the rear of the handgun. Thus the firing pin, as the weapon is cocked, automatically releases the retaining strap, enabling the handgun to be withdrawn from the holster. A person wearing the holster with a holstered handgun, needs only to grasp the handgrip in a normal manner and squeeze the squeeze cocker and withdraw the weapon in a ready to fire condition in one easy smooth motion, since the retaining strap is automatically released.

BACKGROUND

1. Field of the Invention

This invention relates generally to handguns and holsters, and more specifically to means to retain the hand gun in the holster.

2. Description of the Prior Art

A great many varieties of means to retain a handgun in a holster have been conceived. However the most common types have been a retaining strap, or a spring type clamp built into the holster. The retaining strap used currently and in the past is usually a flexible leather strap permanently affixed to the holster on the side of the holster adjacent to the wearer, and said strap passes over the rear of the handgun and snaps to the other side of the holster. Thus to withdraw the handgun from the holster, the wearer must first make a separate motion to unsnap the retaining strap and then a second separate motion of grasping the handgrip.

DESCRIPTION OF THE PREFERRED EMBODIMENT

Figure 1:
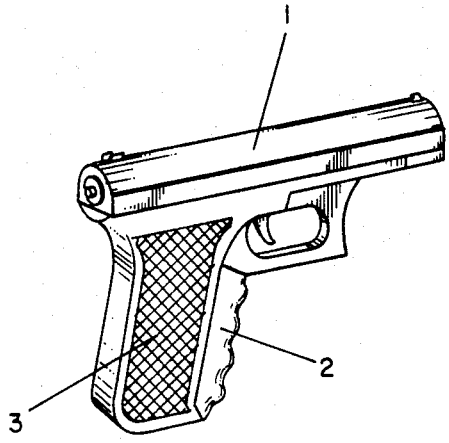
FIG. 1 is an isometric external view of a Heckler and Kock P7 automatic pistol in the uncocked condition.
Figure 2:
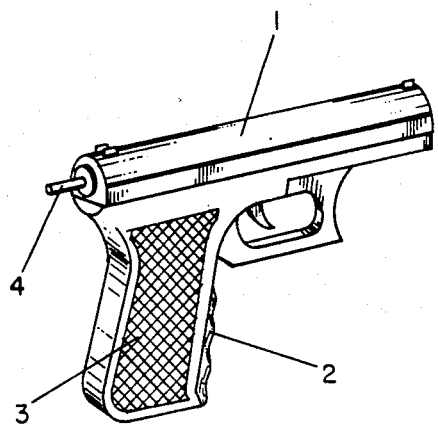
FIG. 2 is an isometric external view of an Heckler and Kock P7 automatic pistol in the cocked condition

Refering to the drawings, FIG. 1 shows a handgun 1 having a squeeze cocker 2 which can be depressed into a handgrip 3 to cock the handgun 1. FIG. 2 shows the handgun 1 with the squeeze cocker 2 depressed, which cocks the handgun 1, and causes a firing pin 4 in the handgun 1 to protrude out the rear of the handgun 1. Typical of the type of handgun 1 is the Heckler and Koch P7 (PSP) Automatic Pistol available through HK, 933 North Kenmore Street, Suite 218, Arlington, Va. 22201.

Figure 3:
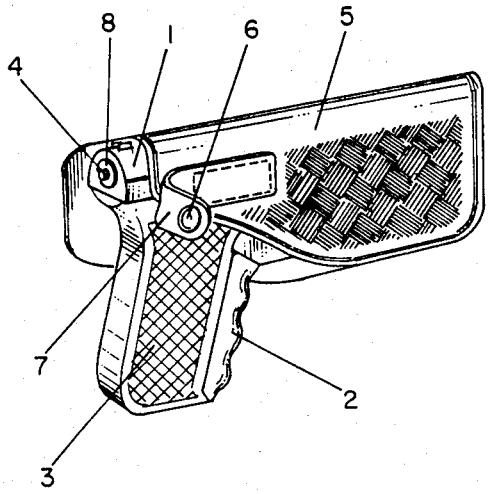
FIG. 3 is an isometric external view of an Heckler and Koch P7 automatic pistol in a holster

FIG. 3 shows the handgun 1 in a holster 5 with a female portion of a snap 6 at an unattached extremity of a retaining strap 7. The retaining strap 7 is attached to the holster 5. The handgun 1 is shown to have a male portion of a snap 8 affixed to the rear of the handgun 1.

Figure 4:
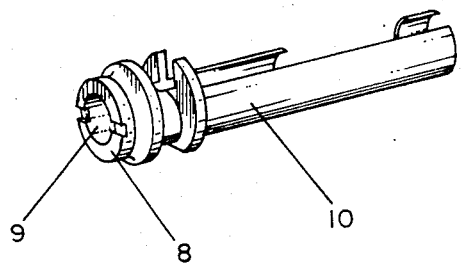
FIG. 4 is an isometric view of a modified bush of an HK P7 (PSP) automatic pistol.

The male portion of the snap 8 is affixed to the rear of the handgun by weldment or made an integral part of the handgun 1 or part thereof. The male portion of the snap 8 has a central orfice 9 as shown in FIG. 4 through which the firing pin 4 will protrude when the handgun 1 is cocked by squeezing the squeeze cocker 2. FIG. 4 shows an enlarged view of a part of the Heckler and Koch P7 (PSP) Automatic Pistol called a bush 10, said bush 10 being modified with the addition of a male portion of the snap 8.

When the handgun 1 is holstered in an uncocked condition the firing pin 4 is retracted inside the handgun 1 and the female portion of the snap 6 is mated to the male portion of the snap 8, thereby enabling the retaining strap 7 to secure the handgun 1 in the holster 5.

To withdraw the handgun 1, the female portion of the snap 6 may be unmated from the male portion of the snap 8 and the handgun 1 withdrawn. For withdrawl of the handgun 1 in a cocked, ready to fire condition, the person wearing the holstered handgun 1 merely grasps the handgrip 3, squeezes the squeeze cocker 2 and withdraws the handgun 1 cocked and ready to fire; because the cocking of the handgun 1 by squeezing the squeeze cocker 2, the firing pin 4 is caused to protrude through the central orfice 9 in the male portion of the snap 8, forcing the female portion of the snap 6 to unmate, freeing the retaining strap 7 from the handgun 1. It is equally contemplated that the male portion of the snap 8 could be affixed without the central orfice 9 to the retaining strap 7 and the female portion of the snap 6 with the central orfice 9 could be affixed to the rear of the handgun 1 as an alternate configuration of the weapon without significantly affecting any significant functions of the invention.

I claim:

1. For a hand gun having a firing pin which protrudes through the rear of the handgun when the handgun is cocked, said firing pin being substantially retracted inside the handgun when the handgun is uncocked, an automatically releasable handgun retaining strap on a holster comprising:

a retaining strap affixed on one end to the holster, and said retaining strap having a female portion of a snap affixed at the unattached end, and a male portion of the snap affixed to the rear of the handgun, said male portion of the snap having a central orfice through which the firing pin may protrude when the handgun is cocked, and wherein the female portion of the snap mates with the male portion of the snap when the handgun is holstered in an uncocked condition.

2. The automatically releasable handgun retaining strap of claim 1 wherein the male portion of the snap is made integral with the handgun or a part thereof.

3. The automatically releasable handgun retaining strap of claim 1 wherein the male portion of the snap is affixed to the handgun or a part thereof as by weldment.

4. For a handgun having a firing pin which protrudes through the rear of the handgun when the handgun is cocked, said firing pin being substantially retracted inside the handgun when the handgun is uncocked, an automatically releasable retaining strap on a holster comprising:

a retaining strap affixed at one end to the holster, and said retaining strap having a male portion of a snap affixed at the unattached end, and a female portion of the snap affixed to the rear of the handgun, said female portion of the snap having a central orfice through which the firing pin may protrude when the handgun is cocked, and wherein the male portion of the snap mates with the female portion of the snap when the handgun is holstered in an uncocked condition.

5. The automatically releasable handgun retaining strap of claim 4 wherein the female portion of the snap is made integral with the handgun or a part thereof.

6. The automatically releasable handgun retaining strap of claim 4 wherein the female portion of the snap is affixed to the handgun or a part thereof as by weldment.

* * * * *